US012780379B2

(12) United States Patent
Arvidsson et al.

(10) Patent No.: US 12,780,379 B2
(45) Date of Patent: Nov. 3, 2026

(54) PROPULSION DRIVE ASSEMBLY WITH GAS SUPPLY TO MITIGATE FOULING

(71) Applicant: VOLVO PENTA CORPORATION, Gothenburg (SE)

(72) Inventors: Lennart Arvidsson, Kållered (SE); Peter Granqvist, Västra Frölunda (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 418 days.

(21) Appl. No.: 18/341,823

(22) Filed: Jun. 27, 2023

(65) Prior Publication Data

US 2023/0415872 A1 Dec. 28, 2023

(30) Foreign Application Priority Data

Jun. 28, 2022 (EP) ..... 22181633

(51) Int. Cl.
*B63H 5/16* (2006.01)

(52) U.S. Cl.
CPC ..... *B63H 5/16* (2013.01)

(58) Field of Classification Search
CPC ... B63H 5/00; B63H 5/07; B63H 5/16; B63H 5/20; B63H 5/125; B63H 5/165; B63H 20/02; B63H 20/04; B63H 20/08; B63H 20/32; F17C 7/00; F17C 13/00; B63B 59/04
USPC ..... 440/1, 53, 54
See application file for complete search history.

(56) References Cited

U.S. PATENT DOCUMENTS

| | | | | |
|---|---|---|---|---|
| 2,156,938 A * | 5/1939 | Edwards | B63H 5/125 440/75 |
| 5,522,744 A * | 6/1996 | Schlogel | B63H 5/125 440/54 |
| 6,056,610 A * | 5/2000 | Fontanille | B63H 25/42 440/54 |
| 2014/0227097 A1 | 8/2014 | Horkko et al. | |

FOREIGN PATENT DOCUMENTS

| | | |
|---|---|---|
| CN | 102666272 A | 9/2012 |
| JP | 2014221570 A | 11/2014 |

OTHER PUBLICATIONS

Extended European Search Report in corresponding European Application No. 22181633.3 dated Dec. 12, 2022 (9 pages).

* cited by examiner

*Primary Examiner* — Daniel V Venne
(74) *Attorney, Agent, or Firm* — Jeffri A. Kaminski; Venable LLP

(57) ABSTRACT

A propulsion drive assembly for a marine vessel is described' The propulsion drive assembly includes a propeller drive unit for carrying and driving at least one propeller, a housing for connection to a hull of the marine vessel, a suspension mechanism attached to the housing and configured to suspend the propeller drive unit, wherein the suspension mechanism is movable along a first longitudinal axis of the housing between a stowed position, in which the propeller drive unit is positioned inside the inner space of the housing, and a deployed position in which at least a portion of the propeller drive unit protrudes outside the housing through the first opening, and a gas supply device configured to supply gas into the inner space of the housing, the gas supply device comprising a gas pump or a controllable valve connectable to a source of pressurized gas.

11 Claims, 2 Drawing Sheets

PROPULSION DRIVE ASSEMBLY WITH GAS SUPPLY TO MITIGATE FOULING

TECHNICAL FIELD

The present disclosure relates to a propeller drive unit for a marine vessel. Specifically, the present disclosure relates to mitigation of fouling and barnacle growth on such propeller drive units.

BACKGROUND OF THE INVENTION

Propeller drive units are commonly used to provide marine vessels with thrust to control movement of the marine vessel relatively a body of water in which the marine vessel floats. Some propeller drive units, such as propeller drive units of outboard motors, may be elevated out of water when not in use. However, propeller drive units mounted under the hull of the marine vessel cannot be folded up over the water surface and hence are subject to fouling and growth of barnacle when not in use. Accordingly, there is a need to mitigate fouling and growth of barnacle on propeller drive units mounted under the hull of the marine vessel.

SUMMARY OF THE INVENTION

An object of the present disclosure is thus to mitigate fouling and growth of barnacle also on a propeller drive unit mounted under the hull of a marine vessel.

According to a first aspect of the present disclosure this object is achieved by a propulsion drive assembly for a marine vessel. The propulsion drive assembly comprises:

- a propeller drive unit for carrying and driving at least one propeller, and
- a housing for connection/attachment to a hull of the marine vessel on an inside of the hull such that the housing surrounds a first opening of the hull and seals to the hull.

The housing defines an inner space and the housing is provided with a second opening through which the at least a portion of the propeller drive unit is movable into and out of the inner space through the first opening of the hull.

The propulsion drive assembly further comprise a suspension mechanism attached to the housing and configured to suspend the propeller drive unit. The suspension mechanism is movable along a first longitudinal axis of the housing between a stowed position, in which the propeller drive unit is positioned inside the inner space of the housing, and a deployed position in which at least a portion of the propeller drive unit protrudes outside the housing through the first opening.

Also, the propulsion drive assembly comprises a gas supply device configured to supply gas into the inner space of the housing, said gas supply device comprising a gas pump or a controllable valve connectable to a source of pressurized gas. The pressure of the pressurized gas should be high enough to enable the gas to be released below water against the water pressure of surrounding water.

When the propeller drive unit is to be used, the suspension mechanism is moved to its deployed position, such that the propeller drive unit is moved out of the housing and able to propel water on an outside of the hull. When not in use, the propeller drive unit is moved back into the inner space of the housing by operating the suspension mechanism to its stowed position. The gas supply device enables water trapped in the inner space to be replaced with gas, such as air, the propeller drive unit is at least partly surrounded by gas rather than water. Hence, since fouling and growth of barnacle is more prone to happen on surfaces surrounded by water than on surfaces surrounded by gas/air, the present solution mitigates fouling and growth of barnacle on the propeller drive unit and on the housing. Also, the stowed position of the propeller drive unit prevents accidental damage to the propeller drive unit and enables a lower total height of the marine vessel, which is advantageous at transportation of the marine vessel by road, for example to be able to pass under bridges.

The suspension mechanism may comprise a piston guided within the housing for movement along the first longitudinal axis. The propeller drive unit is attached to the piston, and the piston seals to the housing thereby separating the inner space into a first space adjacent the second opening, and a second space on the opposite side of the piston. Also, the gas supply device is configured to provide said gas supply into the first space.

As gas is supplied to the first space by the gas supply device, the piston is increasingly forced into the housing by the gas in the first space acted on by surrounding sea water, thereby promoting easier operation of the suspension mechanism to its stowed position for movement of the propeller drive unit into the housing. This enables a lighter and less expensive design of involved components of the propulsion drive assembly.

The suspension mechanism may comprise an actuator assembly configured to control movement of the suspension mechanism between the stowed position and the deployed position.

The actuator assembly enables predictable control of the movement of the suspension mechanism, independently of the weight of the propeller drive unit and independently of an amount of gas supplied by the gas supply device.

The housing may comprise a first end portion for connection to the hull and an opposite second end portion, wherein the actuator assembly comprises an actuator and a drive mechanism controlled by the actuator, said drive mechanism being attached to the second end portion of the housing and to the piston.

The piston seals to the housing such that the second space is dry, that is, the piston seals to the housing at all positions of the suspension mechanism between the stowed position and the deployed position. By providing the actuator assembly at the second end portion of the housing, the actuator assembly is provided in a dry region of the propulsion drive assembly, and thereby protected from water and easier to access from inside the marine vessel for service and repair.

The propulsion drive assembly may further comprise at least one linear guide attached to the piston and configured to guide the piston relatively the second end portion of the housing for movement along said first longitudinal axis.

The provision of one or more linear guides mitigates jamming of the piston with respect to the housing and enables more compact design of the piston since the piston does not need to transfer as much momentum to the housing as compared to a design without the linear guides.

The propulsion drive assembly may further comprise an electronic control unit configured to control at least the gas supply device, wherein the electronic control unit is configured to control the gas supply device in response to an input signal, or to control the gas supply device for a predetermined intermittent supply of gas, or to control the gas supply device for a constant supply of gas.

A constant or intermittent supply of gas ensures a resupply of gas into the housing during long term stowing, thereby replacing any gas that has escaped the housing after movement of the suspension device to its stowed position. A constant supply of gas further reduces a delay between start of stowing of the propeller drive unit and completion of gas filling into the inner space of the housing.

The propeller drive unit may comprise a lower unit provided in the first space, wherein at least the lower unit is rotatable about a first rotational axis parallel to the first longitudinal axis.

Such a rotational configuration of the lower unit, or the whole propeller drive unit including the lower unit, enables the direction of thrust to be controlled. A 360 degree rotation is possible.

The propeller drive unit may further comprise a base unit fixed to the piston in the second space. The lower unit is rotatably attached to the base unit for rotation about the first rotational axis. Also, the base unit is provided with drive means configured to control relative rotation between the base unit and the lower unit.

The lower unit is rotated about the first rotational axis by the drive means such that the direction of thrust can be controlled. By providing the drive means in a base unit provided in the second space, which is separated from sea water by the piston and thus dry, the drive means is protected from water. Also, the drive means may thus be services from within the marine vessel without detaching the propulsion drive assembly. A 360 degree rotation is possible.

According to a second aspect of the present disclosure the above-mentioned object is also achieved by a marine vessel. The marine vessel comprises a hull provided with a first opening below a predetermined waterline level of the hull. The housing is connected/attached to the hull of the marine vessel on an inside of the hull such that the housing covers the first opening of the hull and seals to the hull. The inner space of the housing is accessible through the first opening of the hull.

The first opening of the hull may be positioned such that the propeller drive unit is at least partly below the predetermined waterline level when the suspension mechanism is in the stowed position.

The predetermined waterline level may be at or below the actual waterline level of the hull when the hull is floating in a body of water.

The marine vessel may be a boat or a ship.

DETAILED DESCRIPTION OF PREFERRED EMBODIMENTS

Figure 1:
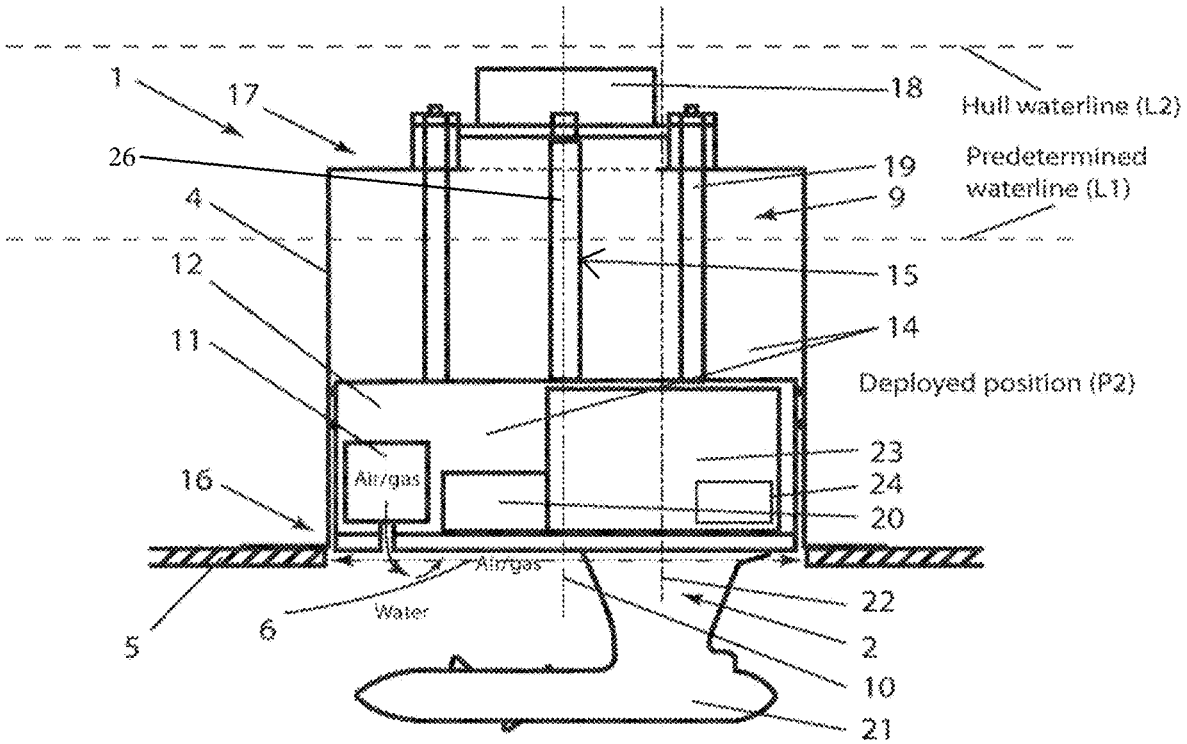
FIG. 1 is a schematic cross-sectional side view of a propulsion drive assembly in a deployed position.
Figure 2:
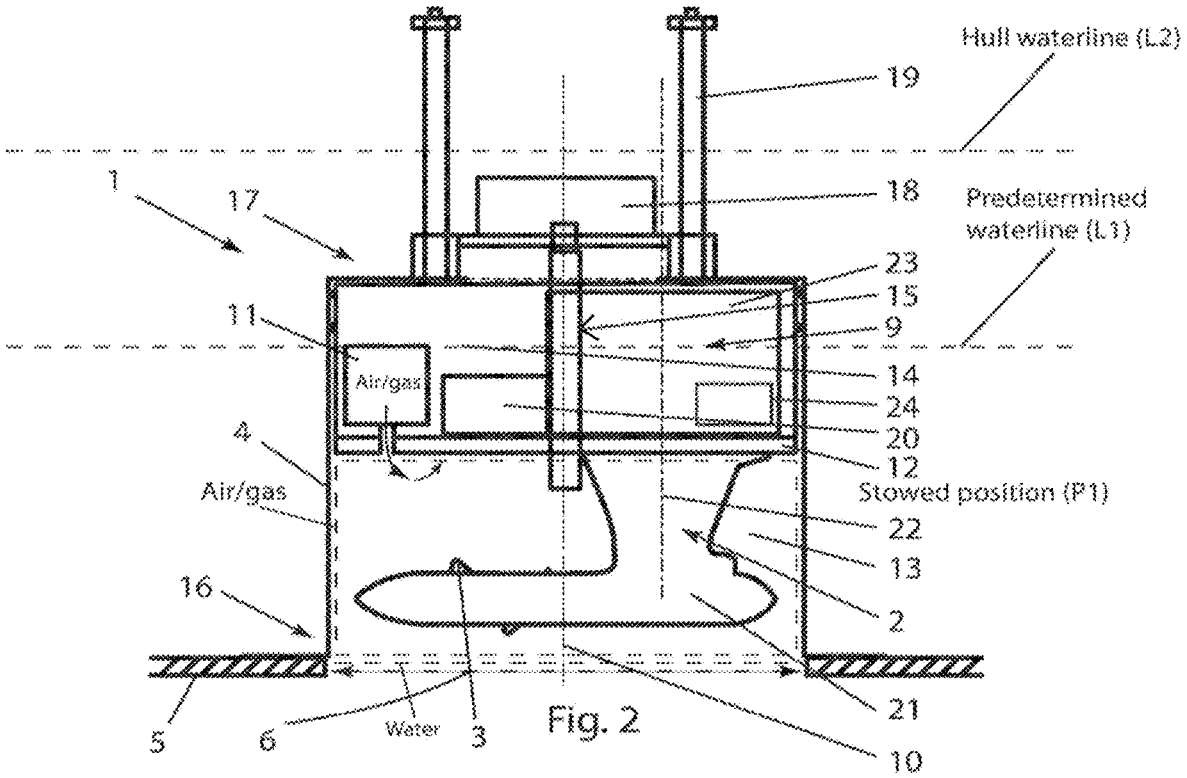
FIG. 2 is a schematic cross-sectional side view of the propulsion drive assembly also shown in FIG. 1, however in a stowed position.

A first embodiment of a propulsion drive assembly 1 according to the present disclosure will hereinafter be described with reference to the appended drawings. The propulsion drive assembly 1 is suitable for use with a marine vessel, such as a boat or a ship. As shown in FIGS. 1 and 2, the propulsion drive assembly 1 comprises a propeller drive unit 2 for carrying and driving at least one propeller 3. The propulsion drive assembly 1 also comprises a housing 4 for connection to a hull 5 of the marine vessel on an inside of the hull 5 such that the housing 4 surrounds a first opening 6 of the hull 5 and seals to the hull 5. The housing 4 defines an inner space 7 and the housing 4 is provided with a second opening 8 through which the at least a portion of the propeller drive unit 2 is movable into and out of the inner space 7 through the first opening 6. A suspension mechanism 9 is attached to the housing 4 and configured to suspend the propeller drive unit 2. The suspension mechanism 9 is movable along a first longitudinal axis 10 of the housing 4 between a stowed position P1 (see FIG. 2), in which the propeller drive unit 2 is positioned inside the inner space 7 of the housing 4, and a deployed position P2 (see FIG. 1) in which at least a portion of the propeller drive unit 2 protrudes outside the housing 4 through the first opening 6. The propulsion drive assembly 1 also comprises a gas supply device 11 configured to supply gas into the inner space 7 of the housing 4. In this embodiment, the gas supply device 11 comprises a gas pump. In other embodiments the gas supply device 11 may instead of a gas pump comprise a controllable valve connectable to a source of pressurized gas.

When the propeller drive unit 2 is to be used, the suspension mechanism 9 is moved to its deployed position, such that the propeller drive unit 2 is moved out of the housing 4 and able to propel water on an outside of the hull 5. When not in use, the propeller drive unit is moved back into the inner space 7 of the housing 4 by operating the suspension mechanism 9 to its stowed position. The gas supply device 11 enables water trapped in the inner space 7 to be replaced with gas, such as air, the propeller drive unit 2 is at least partly surrounded by gas rather than water. Hence, since fouling and growth of barnacle is more prone to happen on surfaces surrounded by water than on surfaces surrounded by gas/air, the present solution mitigates fouling and growth of barnacle on the propeller drive unit 2 and on the housing 4. Also, the stowed position of the propeller drive unit 2 prevents accidental damage to the propeller drive unit 2 and enables a lower total height of the marine vessel, which is advantageous at transportation of the marine vessel by road, for example to be able to pass under bridges. The The suspension mechanism 9 comprises a piston 12 guided within the housing 4 for movement along the first longitudinal axis 10. The propeller drive unit 2 is attached to the piston 12, and the piston 12 seals to the housing 4 thereby separating the inner space 7 into a first space 13 adjacent the second opening 8, and a second space 14 on the opposite side of the piston 12. That is, the piston seals to the housing at all positions of the suspension mechanism between the stowed position and the deployed position. The gas supply device 11 is configured to provide said gas supply into the first space 13.

In other embodiments, the piston 12 may be omitted or replaced by another member designed not to seal to the housing 4. O-rings or other suitable sealing means are provided between the piston 12 and the housing 4.

As gas is supplied to the first space, the piston 12 is increasingly forced into the housing 4 by the gas in the first space acted on by surrounding sea water, thereby promoting easier operation of the suspension mechanism 9 to its stowed position for movement of the propeller drive unit 2 into the housing 4. This enables a lighter and less expensive design of involved components of the propulsion drive assembly 1.

The suspension mechanism 9 comprises an actuator assembly 15 configured to control movement of the suspension mechanism 9 between the stowed position P1 and the deployed position P2.

The actuator assembly 15 enables predictable control of the movement of the suspension mechanism 9, independently of the weight of the propeller drive unit 2 and independently of an amount of gas supplied by the gas supply device 11.

Here, the actuator assembly 15 comprises two spaced-apart feed screws attached to the housing 4 and to the piston 12 such that at joint rotation of the feed screws, the piston 12 is moved within the housing 4 along the first longitudinal axis 10. In other embodiments, any other suitable configuration of the actuator assembly 15 may be used instead, for example only one feed-screw or more than two feed-screws.

In other embodiments, the actuator assembly 15 may be omitted wherein the suspension mechanism 9 may would rather be manually operated.

Figure 3:
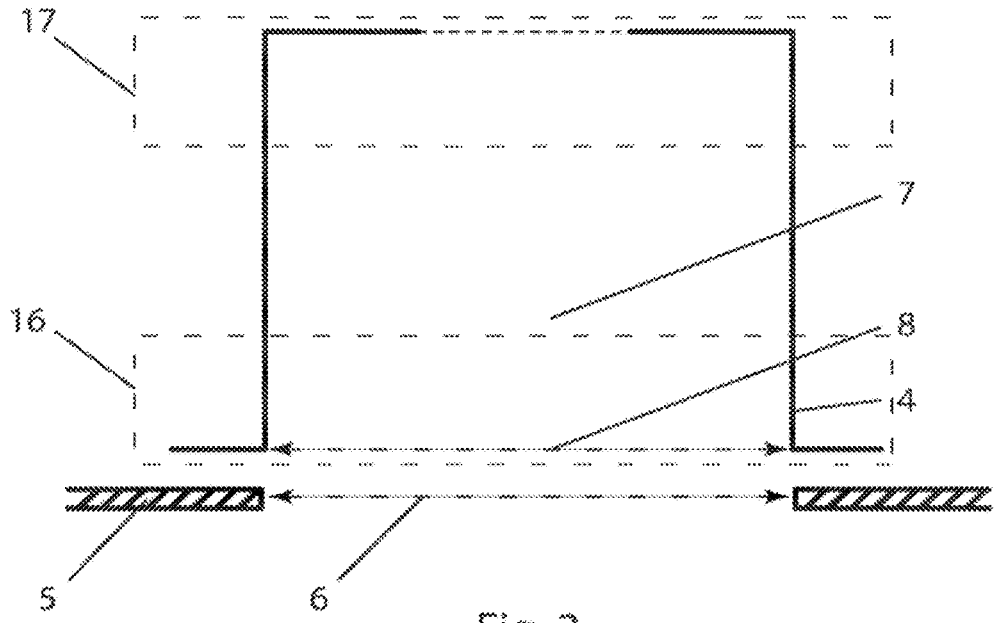
FIG. 3 is a schematic cross-sectional exploded side view showing in isolation a portion of the hull and the housing.

As shown in FIG. 3, the housing 4 may comprise a first end portion 16 for connection/attachment to the hull 5 and an opposite second end portion 17. Said connection could be achieved by attaching a separately formed housing to the hull, such as by welding or gluing, or it could be achieved by integrally forming the housing with the hull, for example by layup of fiber-reinforced plastics. The actuator assembly 15 comprises an actuator 18 and a drive mechanism 26 controlled by the actuator 18, said drive mechanism being attached to the second end portion of the housing 4 and to the piston 12.

In other embodiments, the drive mechanism 26 could have any other suitable design. The piston 12 seals to the housing 4 such that the second space 14 is dry. By providing the actuator assembly 15 at the second end portion of the housing 4, the actuator assembly 15 is provided in a dry region of the propulsion drive assembly 1, and thereby protected from water and easier for access from inside the marine vessel for service and repair.

The propulsion drive assembly 1 further comprises four linear guides 19 attached to the piston 12 and configured to guide the piston 12 relatively the second end portion of the housing 4 for movement along said first longitudinal axis 10. In other embodiments, any other number of linear guides 19 could alternatively be used instead.

The provision of one or more linear guides 19 mitigates jamming of the piston 12 with respect to the housing 4 and enables more compact design of the piston 12 since the piston 12 does not need to transfer as much momentum to the housing 4 as compared to a design without the linear guides 19. In this embodiment, the linear guides are shafts and corresponding bushings riding along the shafts. Opposite ends of the shafts are attached to the housing and the bushings are attached to the piston 12 such that the piston is guided along the shafts. In other embodiments, any other suitable configuration of the linear guides 19 could alternatively be used instead, including, but not limited to, guide rails.

The propulsion drive assembly 1 further comprises an electronic control unit 20 configured to control at least the gas supply device 11. The electronic control unit 20 is configured to control the gas supply device 11 in response to an input signal but could alternatively in other embodiments be configured to control the gas supply device 11 for a pre-determined intermittent supply of gas, or to control the gas supply device 11 for a constant supply of gas. The input signal could be a manually triggered input signal, for example a signal to move the propeller drive unit from the deployed position to the stowed position.

A constant or intermittent supply of gas ensures a re-supply of gas into the housing 4 during long term stowing, thereby replacing any gas that has escaped the housing 4 after movement of the suspension device to its stowed position. A constant supply of gas further reduces a delay between start of stowing of the propeller drive unit 2 and completion of gas filling into the inner space 7 of the housing 4.

An intermittent supply of gas could for example comprise supply of gas at fixed time intervals for a predetermined period of time or using a predetermined mount of gas at each consecutive supply burst. The amount of gas or the time of each burst could be related to the available volume in the first space 13, based on the position of the cylinder 12 within the housing 4. This ensures that enough gas is supplied into the first space 13 to force water out of the first space 13, yet not supplying too much gas such that gas is forced out of the first space 13 and escapes around the hull 5 of the marine vessel.

The propeller drive unit 2 comprises a lower unit 21 provided in the first space 13. At least the lower unit 21 is rotatable about a first rotational axis 22 parallel to the first longitudinal axis 10.

Such a rotational configuration of the lower unit 21, or the whole propeller drive unit 2 including the lower unit 21, enables the direction of thrust to be controlled. A 360 degree rotation is possible in this embodiment, but in other embodiments, the rotation may be limited within predetermined boundaries, for example within a predetermined sector about the first rotational axis 22. Alternatively, the propeller drive unit 2 may be fixed, i.e. the lower unit 21 not being rotatable about a rotational axis parallel to the first longitudinal axis 10.

The propeller drive unit 2 further comprises a base unit 23 fixed to the piston 12 in the second space 14, wherein the lower unit 21 is rotatably attached to the base unit 23 for rotation about the first rotational axis 22, and wherein the base unit 23 is provided with drive means 24 configured to control relative rotation between the base unit 23 and the lower unit 21.

The lower unit 21 is rotated about the first rotational axis 22 by the drive means 24 such that the direction of thrust can be controlled. By providing the drive means 24 in a base unit 23 provided in the second space 14, which is separated from sea water by the piston 12 and thus dry, the drive means 24 is protected from water. Also, the drive means 24 may thus be services from within the marine vessel without detaching the propulsion drive assembly 1. A 360 degree rotation is possible.

In other embodiments, the base unit 23 may be provided anywhere suitable rather than in the second space 14. For example, the base unit 23 could be provided in the first space 13.

It is further suggested to provide a marine vessel comprising a hull 5 with a first opening 6 below a predetermined waterline level L1 of the hull 5. Such a predetermined waterline level is a level on the hull which will be under water when the marine vessel is floating in a body of water under normal conditions. The marine vessel comprises the propulsion drive assembly 1 described above or a propulsion drive assembly 1 according to one of the alternative embodiments described above or defined in the appended claims. The housing 4 of the propulsion drive assembly 1 is connected to the hull 5 of the marine vessel on an inside of the hull 5 such that the housing 4 covers the first opening 6 of the hull 5 and seals to the hull 5. The inner space 7 of the housing 4 is accessible through the first opening 6 of the hull 5.

The first opening 6 of the hull 5 is positioned such that the propeller drive unit 2 is at least partly below the predetermined waterline level L1 when the suspension mechanism 9 is in the stowed position P1.

Preferably, the predetermined waterline level L1 is at or below the actual waterline level L2 of the hull 5 when the hull 5 is floating in a body of water.

The marine vessel is a boat, but could in other embodiments alternatively be any other suitable marine vessel, such as an FPSO vessel.

| | |
|---|---|
| 1 | propulsion drive assembly |
| 2 | propeller drive unit |
| 3 | propeller |
| 4 | housing |
| 5 | hull of marine vessel |
| 6 | first opening (of hull) |
| 7 | inner space of housing |
| 8 | second opening (of housing) |
| 9 | suspension mechanism |
| 10 | first longitudinal axis |
| 11 | gas supply device |
| 12 | piston |
| 13 | first space |
| 14 | second space |
| 15 | actuator assembly |
| 16 | first end portion of housing |
| 17 | second end portion of housing |
| 18 | actuator of actuator assembly |
| 19 | linear guide |
| 20 | electronic control unit |
| 21 | lower unit |
| 22 | first rotational axis |
| 23 | base unit |
| 24 | drive means (for rotation of lower unit) |
| L1 | predetermined waterline level |
| L2 | actual waterline level when marine vessel is floating |

The invention claimed is:

1. A propulsion drive assembly for a marine vessel, said propulsion drive assembly comprising:

a propeller drive unit for carrying and driving at least one propeller, a housing for connection to a hull of the marine vessel on an inside of the hull such that the housing surrounds a first opening of the hull and seals to the hull, wherein the housing defines an inner space and wherein the housing is provided with a second opening through which the at least a portion of the propeller drive unit is movable into and out of the inner space through the first opening, a suspension mechanism attached to the housing and configured to suspend the propeller drive unit, wherein the suspension mechanism is movable along a first longitudinal axis of the housing between a stowed position, in which the propeller drive unit is positioned inside the inner space of the housing, and a deployed position in which at least a portion of the propeller drive unit protrudes outside the housing through the first opening, wherein the suspension mechanism comprises a piston guided within the housing for movement along the first longitudinal axis, and a gas supply device configured to supply gas into the inner space of the housing, said gas supply device comprising a gas pump or a controllable valve connectable to a source of pressurized gas, wherein the propeller drive unit is attached to the piston, wherein the piston seals to the housing at all positions of the suspension mechanism between the stowed position and the deployed position, thereby separating the inner space into a first space adjacent the second opening, and a second space on an opposite side of the piston, and wherein the gas supply device is configured to provide said gas supply into the first space.

2. A propulsion drive assembly according to claim 1, wherein the propulsion drive assembly further comprises at least one linear guide attached to the piston and configured to guide the piston relatively the second end portion of the housing for movement along said first longitudinal axis.

3. A propulsion drive assembly according to claim 1, further comprising an electronic control unit configured to control at least the gas supply device, wherein the electronic control unit is configured to control the gas supply device in response to an input signal, or to control the gas supply device for a pre-determined intermittent supply of gas, or to control the gas supply device for a constant supply of gas.

4. A propulsion drive assembly according to claim 1, wherein the propeller drive unit comprises a lower unit provided in the first space, wherein at least the lower unit is rotatable about a first rotational axis parallel to the first longitudinal axis.

5. A propulsion drive assembly according to claim 4, wherein the propeller drive unit further comprises a base unit fixed to the piston in the second space, wherein the lower unit is rotatably attached to the base unit for rotation about the first rotational axis, and wherein the base unit is provided with drive means configured to control relative rotation between the base unit and the lower unit.

6. A marine vessel comprising a hull provided with a first opening below a predetermined waterline level of the hull, wherein the marine vessel comprises the propulsion drive assembly according to claim 1, wherein the housing is connected to the hull of the marine vessel on an inside of the hull such that the housing covers the first opening of the hull and seals to the hull, wherein the inner space of the housing is accessible through the first opening of the hull.

7. The marine vessel according to claim 6, wherein the first opening of the hull is positioned such that the propeller drive unit is at least partly below the predetermined waterline level when the suspension mechanism is in the stowed position.

8. The marine vessel according to claim 7, wherein the predetermined waterline level is at or below the actual waterline level of the hull when the hull is floating in a body of water.

9. The marine vessel according to claim 6, wherein the marine vessel is a boat or a ship.

10. A propulsion drive assembly according to claim 1, wherein the suspension mechanism comprises an actuator assembly configured to control movement of the suspension mechanism between the stowed position and the deployed position.

11. A propulsion drive assembly according to claim 1, wherein the housing comprises a first end portion for connection to the hull and an opposite second end portion, wherein the actuator assembly comprises an actuator and a drive mechanism controlled by the actuator, said drive mechanism being attached to the second end portion of the housing and to the piston.

* * * * *